US006659123B2

(12) United States Patent
Hyland et al.

(10) Patent No.: US 6,659,123 B2
(45) Date of Patent: Dec. 9, 2003

(54) MAINTAINING READINESS IN FIRE HYDRANTS

(75) Inventors: William Hyland, Camp Hill, OH (US); John H. Hallman, New Waverly, TX (US)

(73) Assignee: Clearwater International, L.L.C., Houston, TX (US)

( * ) Notice: Subject to any disclaimer, the term of this patent is extended or adjusted under 35 U.S.C. 154(b) by 88 days.

(21) Appl. No.: 09/939,228

(22) Filed: Aug. 24, 2001

(65) Prior Publication Data

US 2003/0047210 A1 Mar. 13, 2003

(51) Int. Cl.[7] ..... E03B 7/12; E03B 9/04; C09K 5/20

(52) U.S. Cl. ..... 137/301; 137/1; 138/34; 252/70; 252/75; 252/79

(58) Field of Search ..... 137/1, 59, 301, 137/334; 138/32, 34; 169/5; 252/75, 79, 70

(56) References Cited

U.S. PATENT DOCUMENTS

| | | | | | |
|---|---|---|---|---|---|
| 2,233,185 | A | | 2/1941 | Smith | 252/75 |
| 2,937,009 | A | * | 5/1960 | Anderson | 137/301 |
| 3,384,123 | A | * | 5/1968 | Saddison | 137/301 |
| 3,929,154 | A | * | 12/1975 | Goodwin | 137/59 |
| 4,286,617 | A | * | 9/1981 | Bedient | 137/334 |
| 4,298,021 | A | * | 11/1981 | Bozeman | 137/334 |
| 4,531,538 | A | * | 7/1985 | Sandt et al. | 137/301 |
| 5,104,562 | A | | 4/1992 | Kardos et al. | 252/79 |
| 5,488,968 | A | * | 2/1996 | Price et al. | 137/59 |
| 5,746,240 | A | * | 5/1998 | Ayotte et al. | 137/59 |
| 5,830,380 | A | * | 11/1998 | Cook | 137/301 |
| 5,993,875 | A | | 11/1999 | Hjornevik et al. | 426/327 |
| 6,059,996 | A | | 5/2000 | Minks et al. | 252/395 |
| 6,216,722 | B1 | * | 4/2001 | Solomon | 137/301 |

* cited by examiner

*Primary Examiner*—George L. Walton
(74) *Attorney, Agent, or Firm*—Moser, Patterson & Sheridan, L.L.P.

(57) ABSTRACT

Fire hydrants are protected from freezing by including potassium formate, preferably at least 10% by weight, in the water enclosed in them during nonuse.

12 Claims, 1 Drawing Sheet

MAINTAINING READINESS IN FIRE HYDRANTS

TECHNICAL FIELD

This invention relates to firefighting, and particularly to the use of potassium formate as a freeze point depressant in fire hydrants.

BACKGROUND OF THE INVENTION

In northern climates, a difficult problem for firefighters has been the tendency of the water in fire hydrants to freeze. Frozen water either in the hydrant itself or in the working parts of the valves which operate it may completely prevent use of the hydrant, frustrating any timely efforts to thaw the hydrant or otherwise release the water upstream from the hydrant, thereby risking loss of life and costly destruction of property.

In recent years, a common approach to this problem has been to add one or more glycols to the water in the fire hydrant, and sometimes in the pipe segments near the hydrant valves as well. This has been successful to some degree, but glycols have a tendency to degrade, and some of them are toxic. In addition, glycols can be metabolized by microorganisms under certain conditions, creating foul smells and resulting in decreased effectiveness as a freeze point depressant.

In addition, hydrants are periodically checked for performance, necessitating a release of the contained fluid to the environment. Glycols have an additional disadvantage in that there may be regulatory and liability consequences to their release to the environment. It is highly undesirable for ethylene glycol to find its way into drinking water. Disposal of water containing glycols can be particularly difficult where hundreds of hydrants may be routinely emptied and refilled in a community.

Potassium formate has been suggested for use in solution as a heat transfer medium, as in cooling systems. See Example 2 of David F. Smith's U.S. Pat. No. 2,233,185, and Kardos et al U.S. Pat. No. 5,104,562, which discusses the freeze point of a saturated solution of potassium formate. See also Minks et al U.S. Pat. No. 6,059,996. Gavlin et al, in U.S. Pat. No. 5,853,458, propose the use of potassium formate as a solvent ingredient together with glycols.

Potassium formate was also suggested, in U.S. Pat. No. 5,993,875, to be useful for lowering the freeze point of brines used for preserving fish.

We are not aware, however, of the use of potassium formate in a fire hydrant maintenance system.

DETAILED DESCRIPTION OF THE INVENTION

Figure 1:
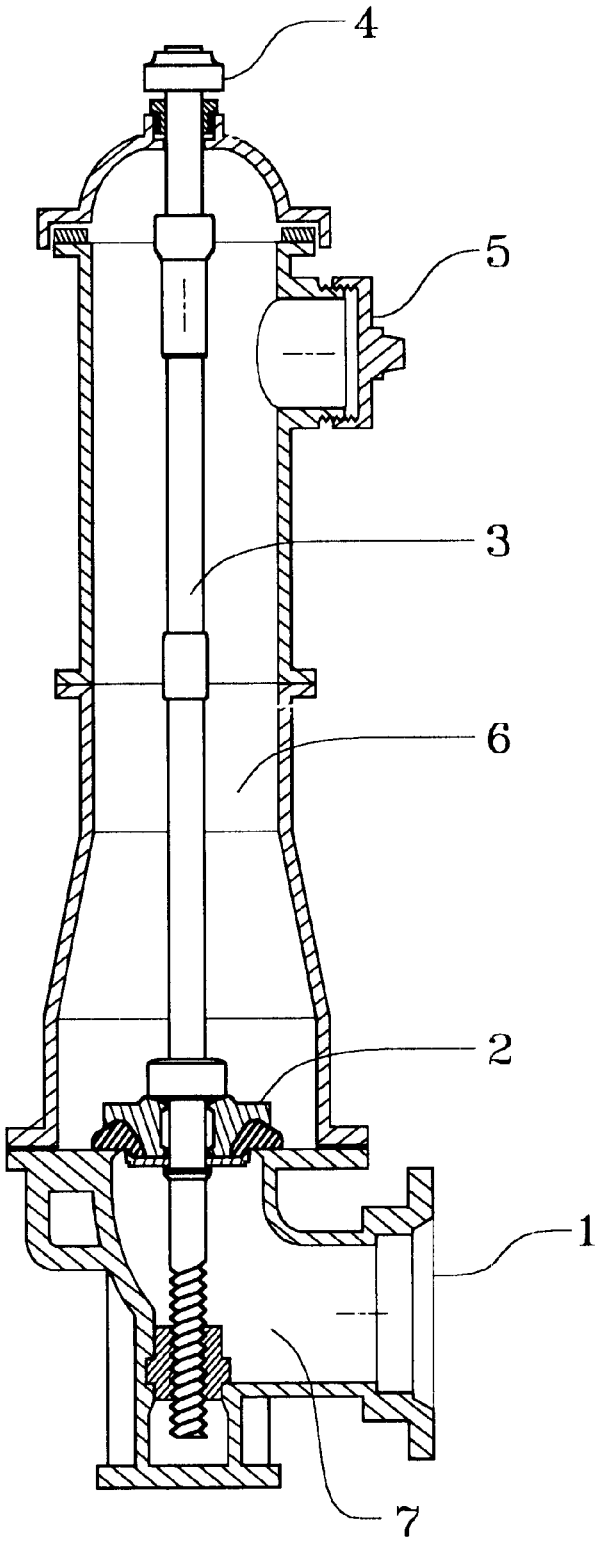
FIG. 1 is a sectional view of a common type of fire hydrant, showing how the invention is used in it.

Referring now to FIG. 1, the hydrant comprises an inlet 1 for a water source under pressure, a valve 2 manually operated through stem 3 having a hexagonal terminus 4, and a water outlet 5 for connection to a hose. Water is present in the hydrant in two places—in the hydrant chamber 6 and entrance elbow 7. Elbow 7 is normally beneath the surface of the earth or pavement, and may therefore be less susceptible to freezing temperatures than the exposed parts, but nevertheless can reach quite low temperatures. The water is quiescent and stationary in both the chamber 6 and the elbow 7, and highly vulnerable to freezing particularly in the chamber 6 and in and around valve 2.

The present invention comprises including in the water in the chamber 6 and/or the elbow 7 an amount of potassium formate effective to reduce the freeze point of the water. Effectiveness will vary with the opinion of the user, the climate or average winter temperature, the altitude, the thickness of pavement over the elbow, and other circumstances. Generally, however, a concentration of at least 10% potassium formate by weight is desirable to reduce the freezing point to a practical level where the temperature is occasionally low enough that freezing can occur. In colder climates, where surface temperatures may be as low as −30° F. for hours, at least 35% potassium formate should be used. As an economic matter, since the labor or effort to mix the potassium formate in the water will be expended more or less regardless of the amount of potassium formate added, there is little point in using a minimal amount. Therefore we prefer to use at least 15% in milder climates and at least 35 in the areas likely to have temperatures in the range of +10° F. to −30° F. in the winter.

The amount of potassium formate in a saturated solution is a function of the solution temperature. While adding more potassium formate to the water than is necessary to make a saturated solution at room temperature may be wasteful, there is no practical reason not to do so; therefore we may use solutions from 10% to saturation, but prefer to use from 10% to 20% for moderate climates and 20% to 45% in colder ones as described above.

Table 1 shows the freeze points of various concentrations, by weight, of potassium formate in aqueous solution:

TABLE 1

Potassium Formate Solution Freeze Points

| Percent by Weight KCOOH | Freeze Point, ° F. |
|---|---|
| 4 | 28 |
| 8 | 23 |
| 12 | 18 |
| 16 | 11 |
| 20 | 4 |
| 24 | −5 |
| 28 | −13 |
| 32 | −25 |
| 36 | −37 |
| 40 | −49 |
| 44 | −61 |
| 48 | −75 |

Unlike the glycols, potassium formate is considered safe, and, under most regulatory regimes, may be released to the environment. In concentrations over about 7%, potassium formate is bacteriostatic. See Siv K. Howard, "Formate Brines for Drilling and Completion," Society of Petroleum Engineers publication 30498, 1995, 483, 486. By contrast, glycols are actually metabolized by microorganisms in warm weather, creating significant stenches.

Our invention includes a regimen for the maintenance of a fire hydrant comprising, prior to cold weather (that is, weather likely to result in frozen hydrants), adding to the hydrant water chamber and/or the elbow upstream of the hydrant valve, a solution of potassium formate of a concentration effective to inhibit freezing, and, after cold weather, removing the solution; this procedure is repeated as cold weather returns. After use in firefighting, new additions should be made to the hydrant. In addition, the regimen includes periodic flushing and replenishing the potassium formate solution. Preferably, the potassium formate solution is flushed and replenished yearly, but flushing and replenishing may satisfactorily be performed every two years. The solution should be sufficient in strength to reduce the freezing temperature at least 10 degrees F., preferably 20 degrees F.

What is claimed is:

1. Method of maintaining a fire hydrant in working condition in cold weather, said fire hydrant having a water chamber, comprising placing in said water chamber an aqueous solution comprising potassium formate, in an amount effective to inhibit freezing.

2. Method of claim 1 wherein said solution comprises potassium formate in an amount from 10% by weight to saturation.

3. Method of claim 1 wherein said solution is placed in said water chamber prior to said cold weather and is drained therefrom following said cold weather, and replaced with water substantially free of potassium formate.

4. Method of claim 1 wherein said hydrant includes a valve for admitting water to said water chamber from an elbow connected to a water pipe, and a solution comprising potassium formate is also added to said elbow.

5. Method of claim 4 wherein said solution in said water chamber and said solution in said elbow each comprise at least 10% potassium formate.

6. Method of claim 3 followed by at least one iteration of the method of claim 3.

7. Method of claim 4 followed by at least one iteration of the method of claim 4.

8. Method of claim 5 followed by at least one iteration of the method of claim 5.

9. Method of claim 1 wherein said solution comprises from 15% to 50% percent potassium formate.

10. Method of inhibiting the growth of microorganisms while also inhibiting freezing in fire hydrants comprising adding to water in a water chamber in said fire hydrants at least 7% by weight potassium formate, whereby both freezing and the growth of microorganisms are inhibited in said water chamber.

11. A fire hydrant having a water chamber containing a solution comprising at least 10% by weight potassium formate, said water chamber being inhibited thereby from freezing.

12. A fire hydrant of claim 11 having an elbow for delivering water from a pipe to said water chamber, said water chamber and said elbow separated by a normally closed valve, and an aqueous solution comprising at least 10% potassium formate in said elbow.

* * * * *